United States Patent [19]

Irrgeher et al.

[11] Patent Number: 4,977,018

[45] Date of Patent: Dec. 11, 1990

[54] SEALING ELEMENT

[75] Inventors: Fritz Irrgeher, Leverkusen-Hitdorf; Frank Schwarze, Cologne, both of Fed. Rep. of Germany

[73] Assignee: Irbit Research & Consulting AG, Fribourg, Switzerland

[21] Appl. No.: 275,448

[22] Filed: Nov. 23, 1988

[30] Foreign Application Priority Data

Nov. 23, 1987 [DE] Fed. Rep. of Germany ..... 8715499
Nov. 25, 1987 [DE] Fed. Rep. of Germany ..... 8715614

[51] Int. Cl.[5] ..... B32B 3/26

[52] U.S. Cl. ..... 428/314.4; 277/228; 404/64; 404/66; 428/57; 428/58; 428/316.6; 428/322.7

[58] Field of Search ..... 428/57, 58, 316.6, 314.4, 428/322.7; 277/228; 404/64, 66

[56] References Cited

U.S. PATENT DOCUMENTS

| | | | |
|---|---|---|---|
| 3,582,095 | 6/1971 | Bogaert | 428/316.6 |
| 4,401,716 | 8/1983 | Tschudin-Mahrer | 428/317.3 |
| 4,615,411 | 10/1986 | Breitscheidel et al. | 428/316.6 |
| 4,621,731 | 11/1986 | Tschudin-Mahrer | 206/83.5 |
| 4,767,655 | 8/1988 | Tschudin-Mahrer | 428/317.1 |

FOREIGN PATENT DOCUMENTS

| | | | |
|---|---|---|---|
| WO80/01892 | 9/1980 | PCT Int'l Appl. | 428/316.6 |
| 986353 | 3/1965 | United Kingdom | 428/316.6 |

*Primary Examiner*—William J. Van Balen
*Attorney, Agent, or Firm*—Martin A. Farber

[57] ABSTRACT

The present invention relates to a sealing element of foam of delayed elastic resilience as a result of impregnation, in which, in order to obtain improved properties, on each cross-sectional plane (2) the delayed resilience is inherent in only a part of the elastically resilient volume and the remaining part (4) of the elastically resilient volume consists of closed-cell foam.

5 Claims, 2 Drawing Sheets

SEALING ELEMENT

FIELD AND BACKGROUND OF THE INVENTION

The present invention relates to a sealing element consisting of foam having delayed elastic resilience as a result of impregnation.

Various types of such sealing elements are already known, reference being had by way of example to German Patent Application No. 3,544,277, European Patent No. 75,955 and European Patent Application No. 84 11 0947.3.

These known sealing elements have the feature in common that in each case substantially an entire sealing joint is filled with resilient impregnated open-cell foam. The adhesive layers or adhesive foils which are in part provided are not of importance in volume.

In certain cases of use, however, it is preferable to introduce as far as possible closed-cell foam into a seal. Closed-cell foam however cannot be impregnated and therefore does not have delayed resiliency. It can therefore not be introduced into a sealing joint in comparably simple manner as in the case of the known sealing elements of impregnated or soaked foam. On the other hand, closed-cell foam is substantially airtight and impervious also, for instance, to steam, but open-cell foam is not.

SUMMARY OF THE INVENTION

In view of the state of the art described above, the object of the invention is to provide a sealing element which has substantially the advantages which are inherent in the delayed resiliency of the known sealing element but has, at least in part, also the advantages resulting from the use of closed-cell foam.

This object is achieved by the invention indicated in feature wherein on each cross sectional plane (2) only a part of the elastically resilient volume exhibits the delayed resilience and the remaining part (4) of the elastically resilient volume consists of closed-cell foam.

In accordance with the invention, a sealing element is created which has, in part, delayed elastic resilience and, in part, merely elastic resilience. On the one hand, in this way properties of a delayed-resilience sealing element can be combined with a sealing element of only elastic resilience. For example, the greater or larger tightness of the closed-cell foam material can be utilized. Furthermore, there is the advantage that a material with non-soakable and nonimpregnatable closed-cell foam, which can be brought into a sealing joint only with difficulty, can be introduced into a sealing joint in simple manner due to the fact that the sealing element of the invention has delayed elastic resilience on a part of its cross-sectional surface.

As a further development of the invention, the part of the cross section of the sealing element which is only elastically resilient is arranged between two parts of delayed elastically resilient foam. The impregnated open-cell foam surrounds both sides of a strip of closed-cell foam. The application against the walls of the sealing joint is in each case effected by the parts of the cross section which consist of open-cell foam while the merely elastically resilient closed-cell foam is present in the central region. The central part of the cross section can be introduced in known advantageous fashion into a sealing joint as a result of the outer parts of delayed elastically resilient foam.

This entails, for example, the advantage that a substantial cross section of the sealing joint can be filled with the relatively tight closed-cell foam.

Similarly, within the scope of the invention, the open-cell impregnated foam of delayed resiliency can be arranged in the central part of the cross section while the closed-cell foam is arranged at the outer parts.

Various possibilities exist for a connecting together of the different layers of the sealing element. First of all, the layers can be bonded to each other. For this purpose the adhesive action of the impregnating agent of the foam of delayed resiliency may be sufficient in itself. Furthermore, the layers can also be connected by a separate adhesive, as known per se. This adhesive can also consist of a foil which is adhesive on both sides.

Another proposal of the invention is to connect the layers in form-locked manner with each other, in which connection the closed-cell foam can form on one side a longitudinally extending rib which is gripped over by the open-cell foam, or vice-versa.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
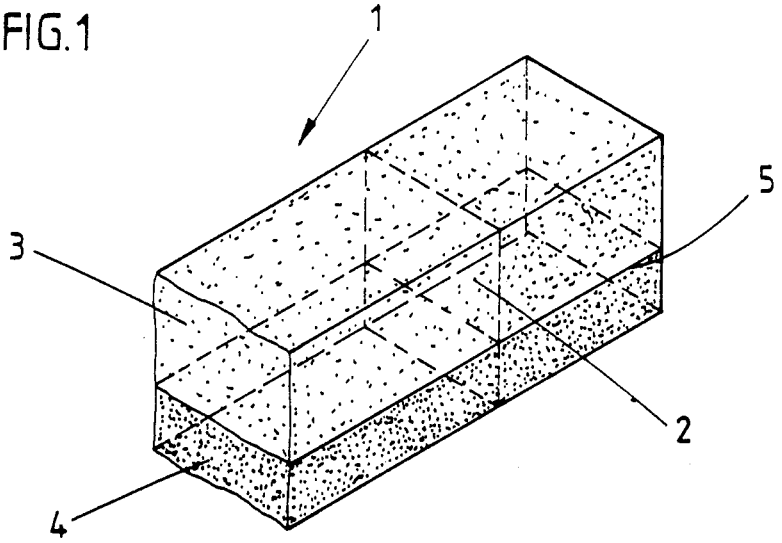
FIG. 1 shows a sealing element in which one outer part of the cross sectional surface consists of a closed cell foam and the other part consists of an open cell foam of delayed resiliency.
Figure 2:
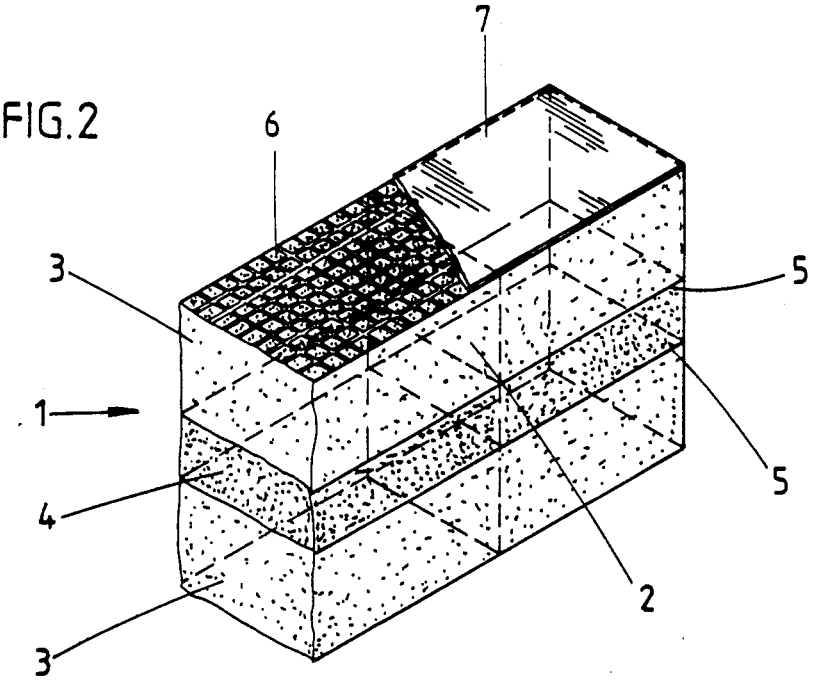
FIG. 2 shows a sealing element in which an inner part of the cross sectional surface consists of closed-cell foam of elastic resiliency while the corresponding outer parts of the cross sectional surface consist of open-cell impregnated foam of delayed resiliency, and, FIG. 3 shows a sealing element consisting of two outer layers of merely elastically resilient foam and an inner layer of foam of delayed resiliency.
Figure 3:
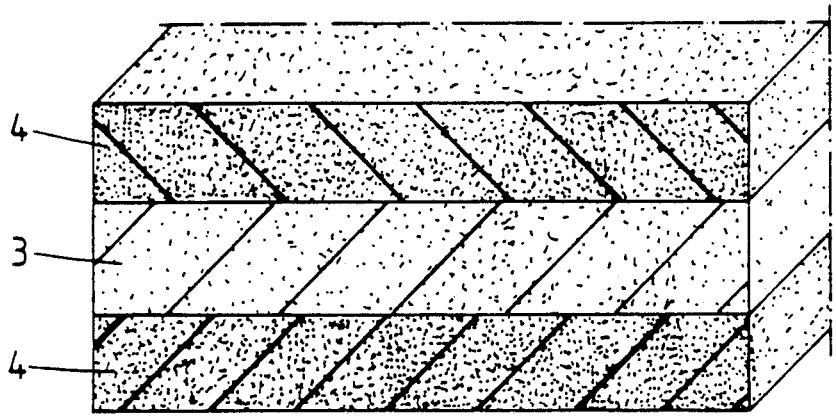

With reference generally to the embodiments of FIGS. 1—3, there are shown and described sealing elements 1 of which a cross sectional surface (2) consists, in part, (3) of open-cell foam which has delayed elastic resilience as a result of impregnation, and, in part, (4) of closed-cell foam which is merely elastically resilient.

The connection between the individual layers 3 and 4 at connection planes 5 can be effected in various ways. For example, the layers can simply be bonded to each other. In addition to this, a form-locked connection can also be provided, either by itself or combined with the aforementioned bonding.

FIG. 1 shows, in detail, a sealing element in which the upper part of the cross section in the drawing consists of impregnated open-cell foam (3) which is elastically resilient and the lower part consists of closed-cell foam which is only elastically resilient (4).

In the showing of FIG. 1, each outer part of the cross sectional surface 2 is filled with a volume of open-cell foam 3 of delayed elastic resilience and an inner part of the cross sectional surface 2 is filled with a volume of closed-cell foam 4 which is only elastically deformable. "Inner part" means here, with respect to an otherwise rectangular cross section of the sealing element 1 shown, that a middle layer is concerned.

In the case of the sealing element shown in FIG. 2 it can furthermore also be noted that in the upper outer surface of the part 3 there is arranged a thread grid structure 6 which furthermore is covered (in delivered condition) by a foil 7.

In the sealing element of FIG. 3, two outer layers 4 of only elastically resilient foam are provided, they surrounding a central layer 3 of open cell foam of delayed resiliency.

We claim:

1. A sealing element comprising a first part of foam and a second part of foam; and wherein the foam of the first part is made as an impregnated open-celled foam, impregnated with material having an adhesive action, having an elastically resilient volume with a property of delayed resilience, the foam of the second part being a closed cell foam having an elastically resilient volume.

2. A sealing element according to claim 1, wherein said first part comprises two sections; and said second part is arranged between the two sections of said first part.

3. A sealing element according to claim 1, wherein said first and said second parts are bonded to each other.

4. A sealing element according to claim 1, wherein said first and said second parts are connected to each other by form locking.

5. A sealing element according to claim 1, wherein said second part comprises two layers; and said first part is arranged between the two layers of said second part.

* * * * *